US007431976B2

(12) United States Patent
Hermann et al.

(10) Patent No.: US 7,431,976 B2
(45) Date of Patent: Oct. 7, 2008

(54) FASTENING MEMBER FOR A MOLDED ARTICLE

(75) Inventors: Charles Hermann, Cleveland Heights, OH (US); Eric Petersen, Medina, OH (US); Thomas Schnorberger, Monroe, MI (US); Jim Cullen, London (CA)

(73) Assignee: Avery Dennison Corporation, Pasadena, CA (US)

( * ) Notice: Subject to any disclaimer, the term of this patent is extended or adjusted under 35 U.S.C. 154(b) by 184 days.

(21) Appl. No.: 11/055,185

(22) Filed: Feb. 10, 2005

(65) Prior Publication Data

US 2005/0189811 A1 Sep. 1, 2005

Related U.S. Application Data

(60) Provisional application No. 60/543,183, filed on Feb. 10, 2004.

(51) Int. Cl.
*A44B 21/00* (2006.01)

(52) U.S. Cl. ..... 428/100; 428/99; 428/119; 428/900; 24/442

(58) Field of Classification Search ..... 428/99, 428/100, 900, 119, 120; 24/442, 306, 444
See application file for complete search history.

(56) References Cited

U.S. PATENT DOCUMENTS

| | | | |
|---|---|---|---|
| 4,470,857 | A | 9/1984 | Casalou |
| 4,563,380 | A | 1/1986 | Black et al. |
| 4,617,214 | A | 10/1986 | Billarant |
| 4,673,542 | A | 6/1987 | Wagner et al. |
| 4,693,921 | A | 9/1987 | Billarant et al. |
| 4,726,975 | A | 2/1988 | Hatch |
| 4,784,890 | A | 11/1988 | Black |
| 4,802,939 | A | 2/1989 | Billarant et al. |
| 4,842,916 | A | 6/1989 | Ogawa et al. |
| 4,881,997 | A | 11/1989 | Hatch |
| 4,931,344 | A | 6/1990 | Ogawa et al. |
| 4,933,035 | A | 6/1990 | Billarant et al. |
| 4,933,224 | A | 6/1990 | Hatch |
| 5,061,540 | A | 10/1991 | Cripps et al. |
| 5,110,649 | A | 5/1992 | Morse et al. |
| 5,171,395 | A | 12/1992 | Gilcreast |
| 5,180,618 | A | 1/1993 | Kessler et al. |
| 5,259,905 | A | 11/1993 | Gilcreast |
| 5,286,431 | A | 2/1994 | Banfield et al. |
| 5,342,569 | A | 8/1994 | Murasaki |
| 5,422,156 | A | 6/1995 | Billarant |

(Continued)

FOREIGN PATENT DOCUMENTS

| | | |
|---|---|---|
| EP | 0 439 969 A1 | 8/1991 |

(Continued)

OTHER PUBLICATIONS

PCT International Search Report, PCT/US2005/004170 dated May 30, 2005.

*Primary Examiner*—Alexander Thomas
(74) *Attorney, Agent, or Firm*—Michael P. Fortkort

(57) ABSTRACT

A fastening member capable of attachment to a molded article is disclosed. The fastening member includes a base with integral longitudinal lips defining the lateral edges of the base and the fastening member. Fastener elements are disposed on the same side of the base as are the lips.

26 Claims, 8 Drawing Sheets

U.S. PATENT DOCUMENTS

| | | | |
|---|---|---|---|
| 5,500,268 | A | 3/1996 | Billarant |
| 5,540,970 | A | 7/1996 | Banfield et al. |
| 5,606,781 | A | 3/1997 | Provost et al. |
| 5,614,045 | A | 3/1997 | Billarant |
| 5,654,070 | A | 8/1997 | Billarant |
| 5,665,449 | A | 9/1997 | Billarant |
| 5,688,576 | A | 11/1997 | Ohno et al. |
| 5,725,928 | A | 3/1998 | Kenney et al. |
| 5,736,217 | A | 4/1998 | Banfield et al. |
| 5,766,385 | A | 6/1998 | Pollard et al. |
| 5,766,723 | A | 6/1998 | Oborny et al. |
| 5,786,061 | A | 7/1998 | Banfield |
| 5,795,640 | A | 8/1998 | Billarant |
| 5,840,398 | A | 11/1998 | Billarant |
| 5,850,645 | A | 12/1998 | Ogawa et al. |
| 5,900,303 | A | 5/1999 | Billarant |
| 5,922,436 | A | 7/1999 | Banfield et al. |
| 5,932,311 | A | 8/1999 | Kenney et al. |
| 5,942,177 | A | 8/1999 | Banfield |
| 5,945,193 | A | 8/1999 | Pollard et al. |
| 5,972,465 | A | 10/1999 | Ohno et al. |
| 6,129,970 | A | 10/2000 | Kenney et al. |
| 6,148,487 | A | 11/2000 | Billarant |
| 6,299,954 | B1 | 10/2001 | Schulte |
| 6,348,252 | B1 | 2/2002 | Kenney et al. |
| 6,460,230 | B2 | 10/2002 | Shimamura et al. |
| 6,463,635 | B2 | 10/2002 | Murasaki |
| 6,468,371 | B1 | 10/2002 | Poulakis |
| 6,537,643 | B1 | 3/2003 | Poulakis |
| 6,540,863 | B2 | 4/2003 | Kenney et al. |
| 6,596,371 | B1 | 7/2003 | Billarant et al. |
| 6,720,059 | B2 * | 4/2004 | Fujisawa et al. ..... 428/100 |
| 6,842,950 | B2 * | 1/2005 | Fleuchaus et al. ..... 24/442 |
| 2001/0038161 | A1 | 11/2001 | Kenney et al. |
| 2002/0023322 | A1 | 2/2002 | Murasaki |
| 2002/0058123 | A1 | 5/2002 | Kenney et al. |
| 2002/0101109 | A1 | 8/2002 | Stiller et al. |
| 2002/0164451 | A1 | 11/2002 | Fujisawa et al. |
| 2003/0072912 | A1 | 4/2003 | Itoh |
| 2003/0099811 | A1 | 5/2003 | Poulakis |
| 2003/0214068 | A1 | 11/2003 | Fujisawa et al. |

FOREIGN PATENT DOCUMENTS

| | | | |
|---|---|---|---|
| EP | 0 562 820 | A1 | 9/1993 |
| EP | 0 904 707 | A1 | 3/1999 |

* cited by examiner

FASTENING MEMBER FOR A MOLDED ARTICLE

CROSS REFERENCE TO RELATED APPLICATION

This application claims the benefit under 35 U.S.C. § 119 (e) of U.S. Provisional Application 60/543,183 filed Feb. 10, 2004, entitled FASTENING MEMBER FOR A MOLDED ARTICLE, which application is hereby incorporated by reference in its entirety.

FIELD OF THE INVENTION

This invention relates to fastening members, and, more particularly, to fastening members having integral longitudinal lips and that are capable of being attached to a molded article.

BACKGROUND

Separable fasteners are used in a variety of applications to join two objects. Hook and loop fasteners are a well-known example of separable fasteners in which a first object is provided with hook elements and a second object is provided with loop elements. The hook elements and the loop elements interact to separably fasten the two objects.

In one application of separable fasteners, a molded article carries one set of fastener elements to fasten to a corresponding set of fastener elements carried by another object. Such molded articles include seats made for automobiles, airplanes, boats, furniture, etc. The seats have a cushion carrying one or more fastening members with separable fastener elements capable of attaching to, for example, corresponding fastener elements carried on an upholstery cover for the cushion.

Typically, a fastening member having hook elements is molded into the surface of the molded article as the article is molded. In doing so, these hook elements will be fouled by liquid molding material unless the molding material is prevented from flowing between and around the hook elements. Prevention of this fouling is conventionally done, for example, by covering the hook elements with a removable film or placing an external gasket on the perimeter of the fastening member before placing the member into the mold to provide a seal against the liquid molding material.

SUMMARY OF THE INVENTION

A fastening member capable of being attached to a molded article, such as being embedded in its surface, that reduces or eliminates the amount of molding material that interferes with the fastener elements during the molding process is disclosed. The fastening member includes a base having a top side and a bottom side. There is at least one fastener element on the top side of the base extending to a first height from the base. In one embodiment, at least one fastener element is a hook-shaped element. In another embodiment, at least one fastener element is a loop-shaped element. The top side also includes integral longitudinal lips defining the lateral edges of the base and of the fastening member. The lips extend to a second height from the base. In one embodiment, the second height is equal to or greater than the first height.

In one embodiment, an anchor layer is attached to the bottom side of the base. The anchor layer is capable of securing the fastening member to molding material in the molded article. Preferably, the anchor layer includes a non-woven fabric. Embodiments also include an extension of non-woven fabric substantially perpendicular to the base and extending opposite the fastener elements and extension laterally beyond the lips in, for example, a scalloped shape. In another embodiment, the anchor layer includes molded anchor studs.

A magnetically attractable layer is located between the anchor layer and the bottom side of the base. In one embodiment, the magnetically attractable layer includes a metal strip.

Also disclosed is a method for making a fastening member. In one embodiment, the fastening member is made by extruding a base having a top side and a bottom side. The base is extruded with at least one fastener element integral with the top side of the base. The base is also extruded with longitudinal lips integral to the top side. The integral longitudinal lips define the lateral edges of the base and the fastening member.

The base is cut to a desired length. Then a first non-foam polymer is applied transversely across and in contact with the base between the lips to provide a first seal. A second non-foam polymer is applied transversely across and in contact with the base between the lips to provide a second seal at a location separate from the first seal.

In another embodiment, the first or the second non-foam polymer is applied transversely across and in contact with the base between the lips to provide the first or second seals before the base is cut. The base is then cut to a desired length through the first seal or the second seal. The first and second non-foam polymers may be applied in fluid form and allowed to substantially solidify.

In other embodiments, a foam/film laminate is inserted between the lips before or after the base is cut to provide the first or second seal. The film portion of the laminate is, for example, a nonwoven material, thermoplastic film, or woven fabric.

In one embodiment, the method includes attaching an anchor layer to the bottom side of the base. Preferably, an adhesive layer is applied between at least a portion of the anchor layer and the bottom side of the base to effect the attachment. A magnetically attractable layer may be placed between the anchor layer and the bottom side of the base before attaching the anchor layer to the base.

Also disclosed is a molded article having at least one fastening member attached thereto. The fastening member includes a base having a top side and a bottom side, with integral longitudinal lips on the top side defining the lateral edges of the fastening member and the base. Fastener elements are integral with the top side of the base. In one embodiment, the fastening member is attached to the molded article during the molding of the article.

DRAWINGS

In the accompanying drawings, which are incorporated in and constitute a part of this specification, embodiments of the invention are illustrated, which, together with a general description of the invention given above and the detailed description given below, serve to exemplify the principles of this invention, wherein.

DETAILED DESCRIPTION OF THE INVENTION

Figure 1:
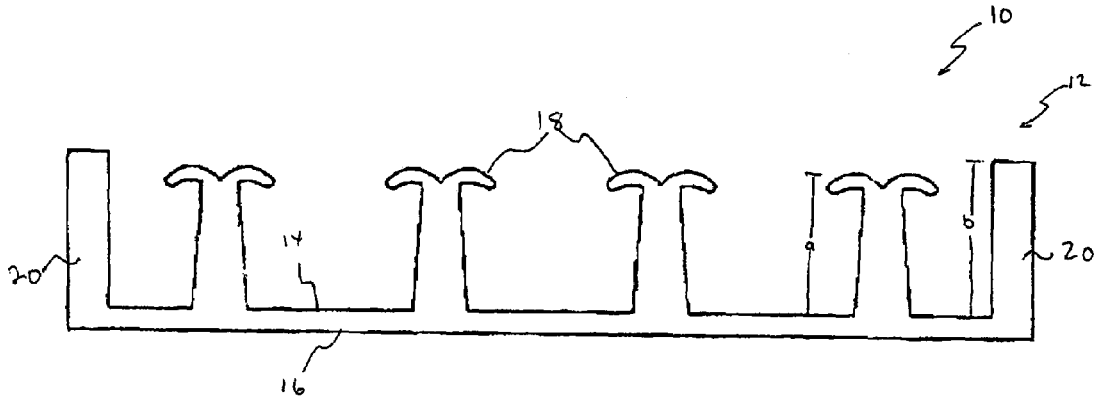
FIG. 1 is an end elevational view of one embodiment of a fastening member in accordance with the present invention.

A fastening member 10 of the present invention is capable of being attached to a molded article and includes a base 12 having a top side 14 and a bottom side 16, as illustrated in FIG. 1. Fastener elements 18 are disposed on the top side 14 of the base 12. The fastener elements 18 extend to an average height a. The fastener elements 18 also may extend to a variety of heights either randomly or in a predetermined pattern. See FIG. 2. There is at least one fastener element 18, but the number of fastener elements may be selected without departing from the spirit and scope of the invention.

Longitudinal lips 20 are integrally formed with the base 12. Integral formation of the longitudinal lips 20 facilitates manufacture of the base 12. The lips 20 extend to a height b. In one embodiment, height b is equal to or greater than height a.

Figure 2:
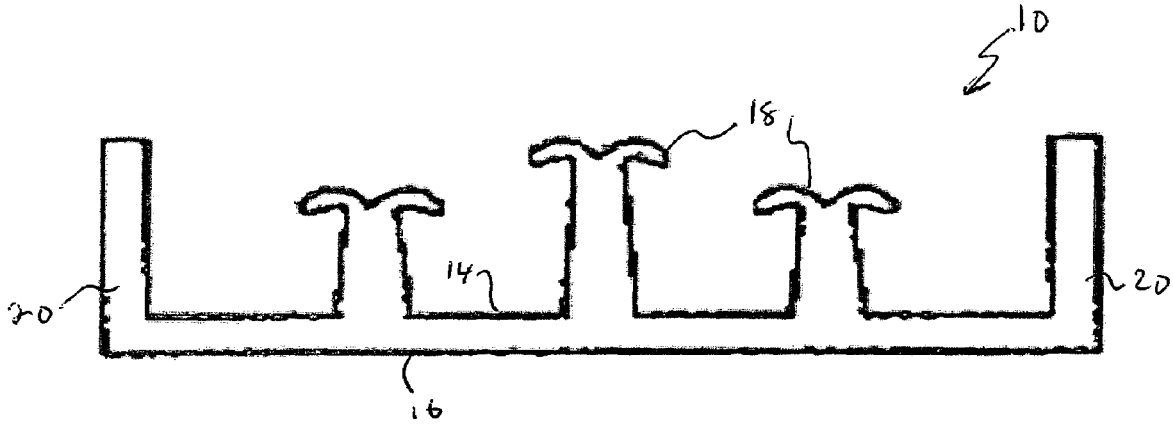
FIG. 2 is an end elevational view of another embodiment of a fastening member in accordance with the present invention.
Figure 3:
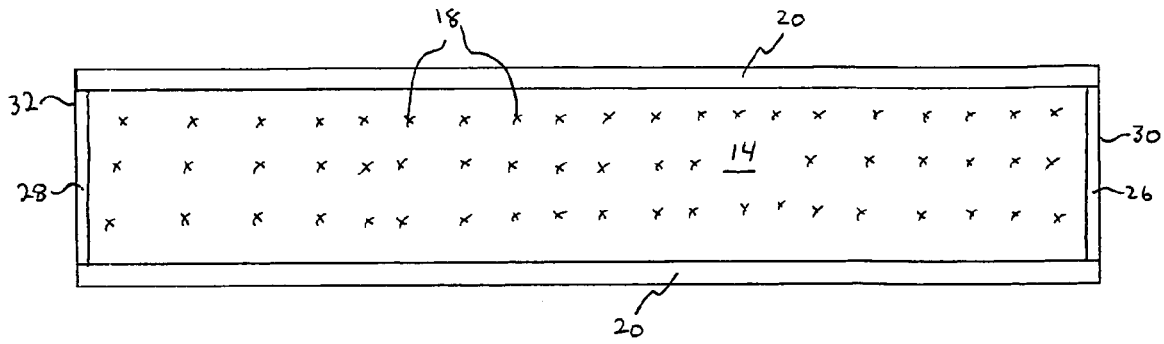
FIG. 3 is a top view of one embodiment of a fastening member in accordance with the present invention.

As illustrated in FIGS. 1, 2, and 3, the longitudinal lips 20 define the lateral edges of the fastening member 10 and the base 12. The base 12 of fastening member 10 does not have portions that extend outwardly from the lips 20. The lips 20 prevent fouling of the fastener elements 18 by molding material of the molded article, as described in greater detail below. One benefit of longitudinal lips 20 defining the lateral edges of the fastening member 10 is a fastening member 10 that is narrower than conventional fastening members with material extending outwardly from peripheral gaskets but that contains an equal or greater number of fastener elements 18.

In one embodiment, the base 12 is a polymer, such as a thermoplastic polymer. For example, the polymer is selected from the group consisting of nylon or other polyamides, polypropylene, polyethylene, polyethylene terephthalate, and co-polymers, derivatives, and mixtures thereof. In one embodiment, the polymer is nylon. The base 12 is, for example, extruded and the lips 20 are of the same material and are extruded with the base 12. In another embodiment, the lips 20 are made from a different polymer and are co-extruded with the base 12.

The lips 20 are disposed at about a 90 degree angle relative to the top side 14 of the base 12 in one embodiment. In another embodiment, the lips 20 are disposed at an angle greater than about 90 degrees relative to the top side 14 of the base 12. In some embodiments, one lip 20 are disposed at a different angle than the other lip 20, or one or both lips are disposed at an angle less than about 90 degrees.

In the embodiment illustrated in FIG. 1, the fastener elements 18 are hooks, such as for attachment to corresponding loop-shaped elements in a hook-and-loop arrangement. The particular shape of the hooks in fastener element 18, and the pattern of their arrangement on the top side 14, may be selected without departing from the spirit and scope of the invention. In one embodiment, the fastener elements 18 are shaped in a palm-tree hook configuration, such as illustrated in FIG. 1. In another embodiment, the fastener elements 18 have a loop shape, such as for attachment to corresponding hook-shaped elements in a hook-and-loop arrangement.

Figure 4:
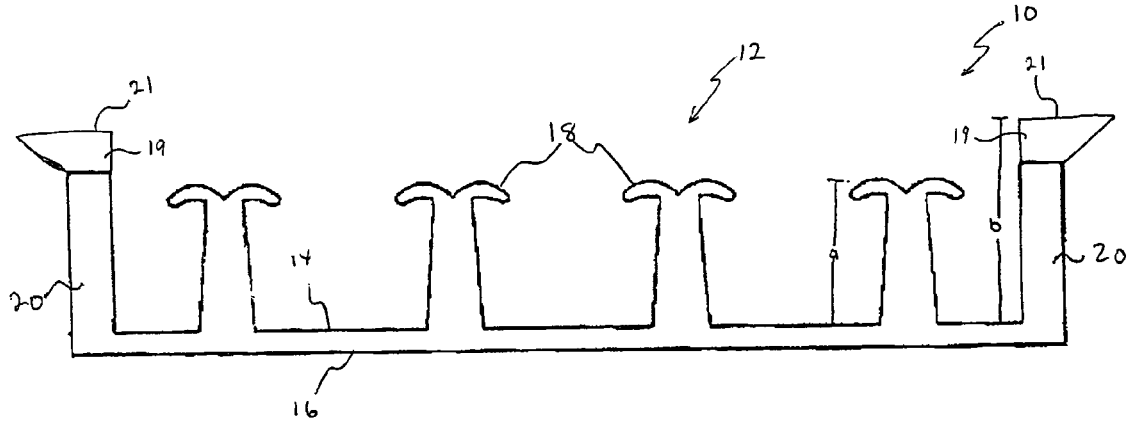
FIG. 4 is is an end elevational view of another embodiment of a fastening member in accordance with the present invention.

FIG. 4 illustrates one embodiment in which an extension 19 is provided as part of the lips 20. In this embodiment, height b includes the extensions 19. As illustrated in FIG. 4, the extensions 19 each have a surface 21 with a lateral extent greater than the width of the associated lip 20. The surfaces 21 are preferably substantially parallel to the base 12. The extensions 19 illustrated in FIG. 4 have a cross section in the form of an inverted, truncated right triangle; however, they may be of any shape without departing from the spirit and scope of the invention.

The extensions 19 may be of the same material as the lips 20, and are preferably integrally formed therewith. The extensions 19 also may be of different material than the lips 20 and co-extruded therewith. Preferably, the material of the extensions 19 has greater deformability than the material of the lips 20.

Figure 5:
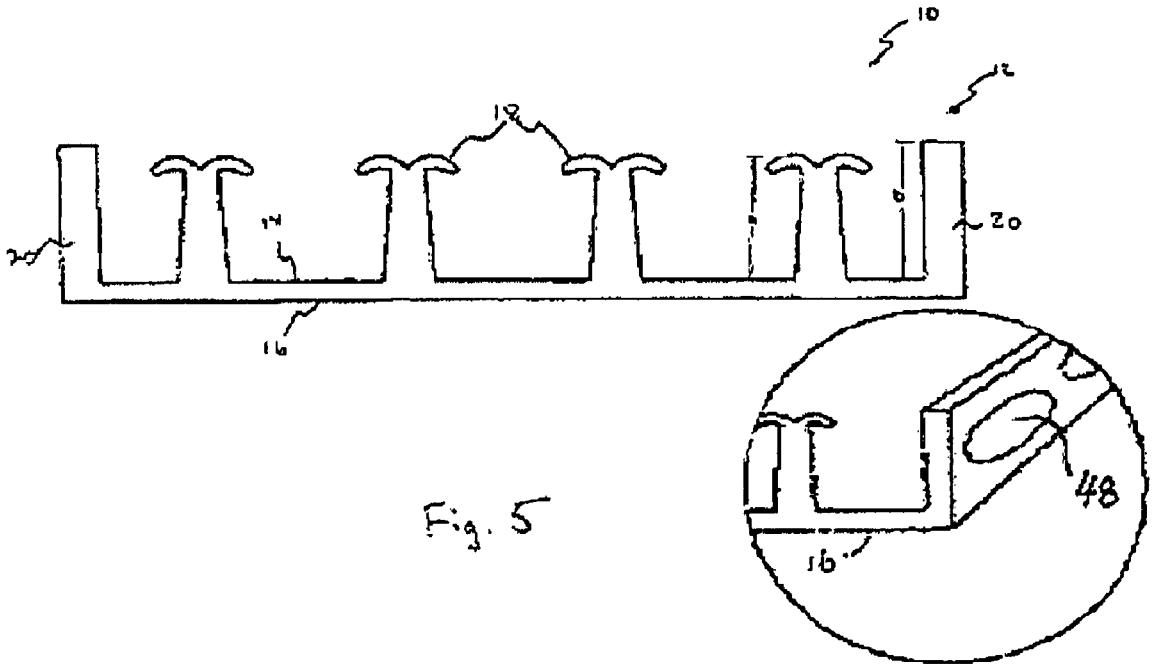
FIG. 5 is an end elevational view of one embodiment of a fastening member in accordance with the present invention.

FIG. 5 illustrates another embodiment of the present invention in which the lips 20 are formed with an hollow interior portion or cavity 48. The cavity 48 may extend for the length of the lip 20 along the fastening member 10 or be provided only in selected portions along the length of the lip 20. The size of the cavity in each of the three dimensions may be selected without departing from the spirit and scope of the invention.

Figure 6:
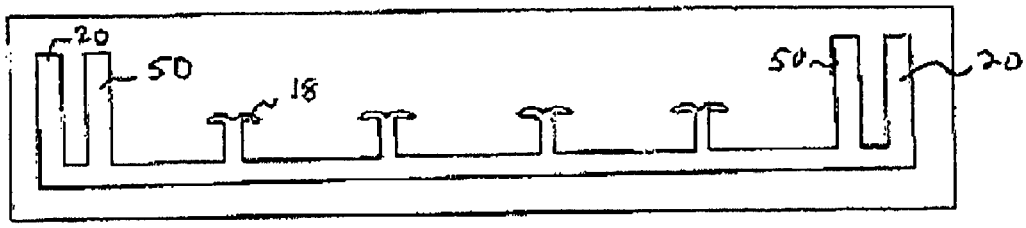
FIG. 6 is an end elevational view of one embodiment of a fastening member in accordance with the present invention.

FIG. 6 illustrates another embodiment of the present invention in which a longitudinal wall 50 is provided laterally external to the fastener elements 18 and laterally internal to lips 20. The longitudinal wall 50 is provided on one or both sides of the base 12 and is, for example, extruded integrally with the base 12 as are the lips 20. The longitudinal wall 50 is disposed at the same height as the lips 20. Other embodiments include the longitudinal wall 50 provided at a different height than the lips 20.

Figure 7:
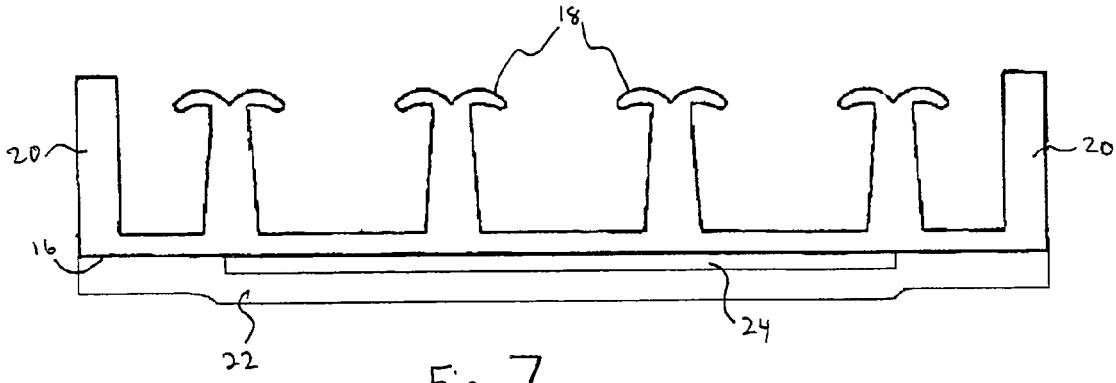
FIG. 7 is an end elevational view of one embodiment of a fastening member in accordance with the present invention.
Figure 8:
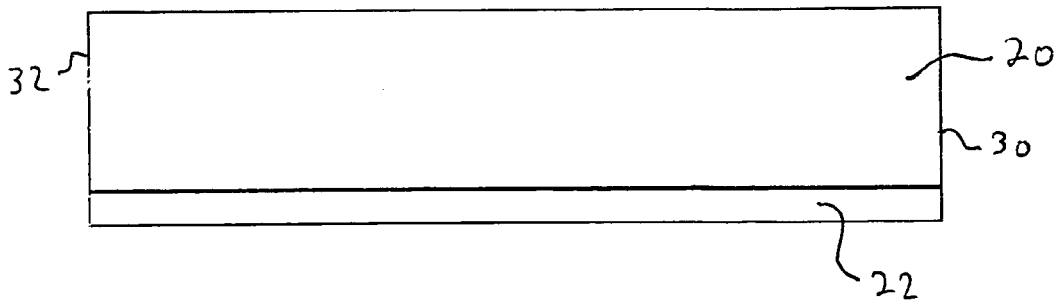
FIG. 8 is a side elevational view of one embodiment of a fastening member in accordance with the present invention.

In one embodiment, an anchor layer 22 is attached to the bottom side 16 of the base 12, as shown in FIGS. 7 and 8. In one embodiment, the attachment is by ultrasonic welding. This attachment also may be accomplished by an adhesive between at least a portion of the anchor layer 22 and the bottom side 16 of the base 12. The adhesive may be any suitable adhesive.

Other possible attachment methods include embedding the anchor layer 22 in the bottom side 16 of the base 12 while the base 12 is still soft following extrusion; using staples, brads, or other mechanical fastening; and pressure bonding or welding the anchor layer 22 to the bottom side 16. This attachment may be accomplished in any manner without departing from the spirit and scope of the invention.

Figure 9:
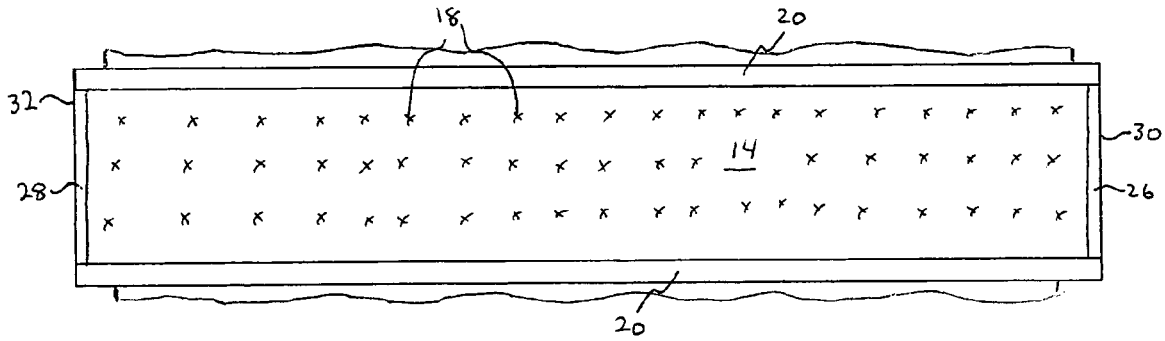
FIG. 9 is a side elevational view of one embodiment of a fastening member in accordance with the present invention.

FIG. 9 illustrates one embodiment of the present invention in which the anchor layer 22 extends laterally past the lips 20, for example, between about 1 mm and 4 mm past the lips 20. FIG. 9 illustrates a scalloped shape to the extensions of the anchor layer 22. Other embodiments include providing the lateral extension in different configurations and shapes.

The anchor layer 22 is capable of attachment to a molded article. Preferably the anchor layer 22 is capable of attachment to the molding material used to fabricate the molded article as the molding material solidifies, as discussed in more detail below. In one embodiment, the anchor layer 22 is a fabric, for example, a non-woven fabric.

As further illustrated in FIG. 7, one embodiment of the present invention includes a magnetically attractable layer 24 between the anchor layer 22 and the bottom side 16 of the base 12. The magnetically attractable layer 24 is capable of cooperating with a mold to secure the position of the fastening member 10 after it is placed in the mold for attachment to the molded article, as discussed in greater detail below.

The magnetically attractable layer 24 includes, for example, at least one metal strip. The layer 24 also may include metal studs, staples, pieces, particulates, or any other magnetically attractable material without departing from the spirit and scope of the invention. In one embodiment, the magnetically attractable material is embedded in or otherwise a part of the base 12.

The magnetically attractable layer 24 preferably is at least partially surrounded by the anchor layer 22. Thus, the layer 24 is held in place without the need to attach the magnetically attractable layer to the bottom side 16 of the base 12 or to the anchor layer 22. As illustrated in FIG. 7, the layer 24 need not extend to the lateral edges defined by the longitudinal lips 20.

In other embodiments, the magnetically attractable layer 24 is attached to the anchor layer 22 or to the bottom side 16 of the base 12 or does extend to the lateral edges of the base 12. Moreover, the magnetically attractable layer 24 need not extend the entire length of the fastening member 10. And the magnetically attractable layer 24 may be continuous or discontinuous. The extent of the magnetically attractable layer 24 and the attachment of this layer 24 to the fastening member 10 may be selected without departing from the spirit or scope of the invention.

Figure 7A:
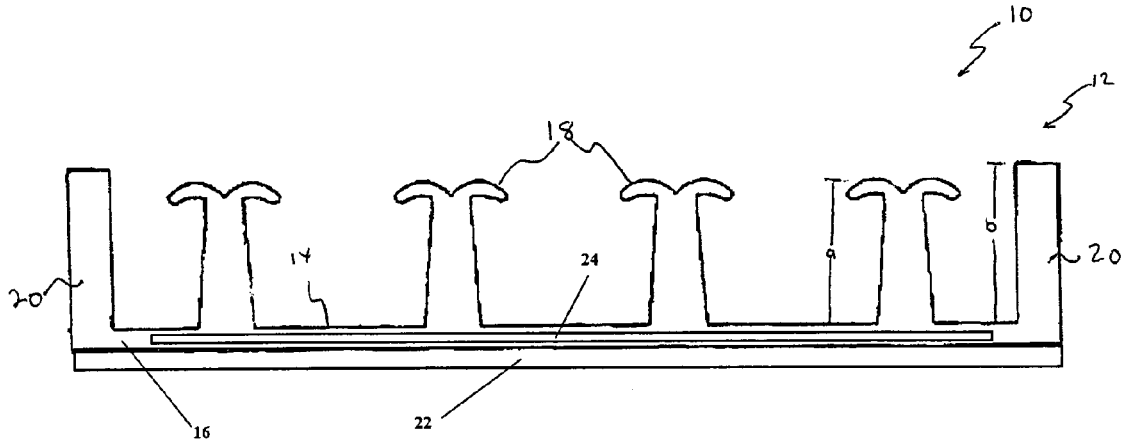
FIG. 7A is an end elevational view of one embodiment of a fastening member in accordance with the present invention.

As illustrated in FIG. 7*a*, other embodiments includes the magnetically attractable layer 24 within the base 10, such as integrally incorporated therein. The magnetically attractable layer within the base 10 may be discrete or continuous.

Figure 10:
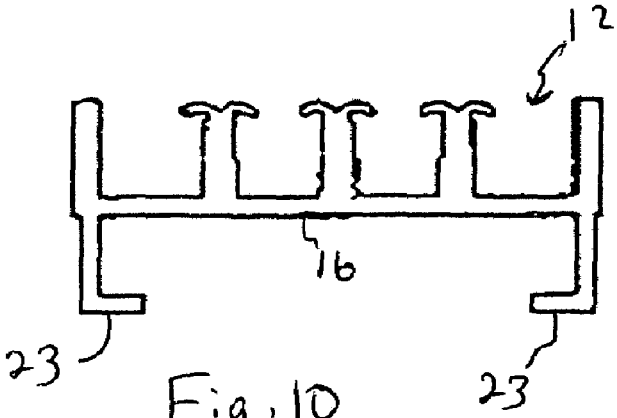
FIG. 10 is a perspective view of one embodiment of a fastening member in accordance with the present invention.
Figure 11:
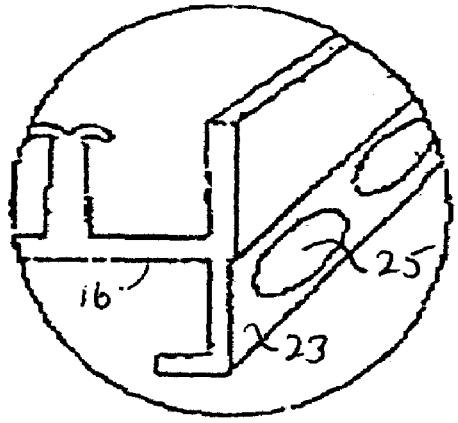
FIG. 11 is a side elevational view of one embodiment of a fastening member in accordance with the present invention.
Figure 12:
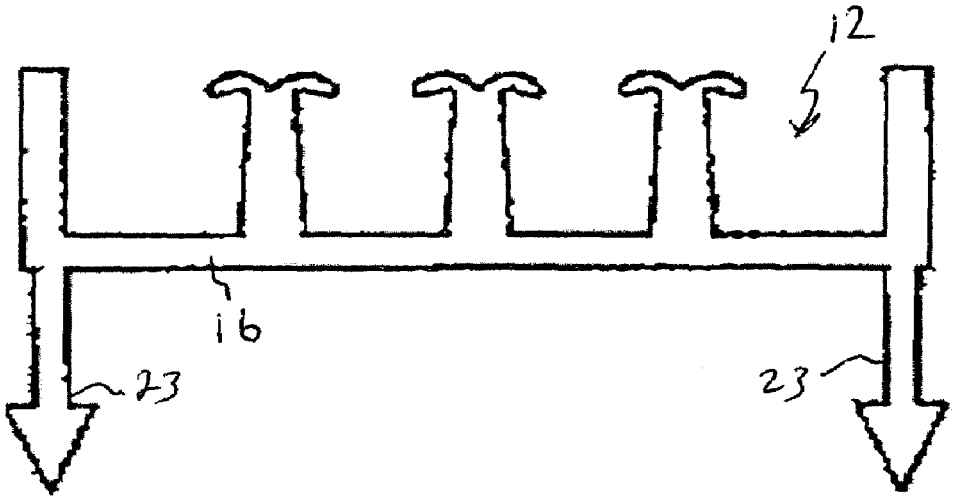
FIG. 12 is a representational view of a fastening member in accordance with the present invention in a mold.

In embodiments illustrated in FIGS. 10, 11, and 12, there are anchor studs 23 attached to the bottom side 16 of the base 12. These studs 23 may be extruded integrally with the base 12 or co-extruded with the base 12. They may also be attached to the bottom side 16 of the base 12 without being integral with the base 12.

Preferably, the anchor studs 23 extend from the bottom side 16 of the base 12 opposite the lips 20, as illustrated in FIGS. 10, 11, and 12. The anchor studs 23 may be an extension of the lips 20 on the opposite side of the base 12. Anchor studs 23 are, for example, L-shaped and, as illustrated in FIG. 11, provided with at least one hole or channel 25 therethrough. The hole or channel 25 is provided to allow liquid molding material to flow through the anchor studs 23 to minimize the force applied against the anchor studs 23 by the liquid molding material. If sufficient force is applied against the anchor studs 23 by the liquid molding material during molding of the molded article to which the fastening member 10 is to be attached, the fastening member 10 may be undesirably displaced during the molding of the molded article.

In one embodiment, the anchor studs 23 extend longitudinally along the bottom side 16 of the base 12 opposite the lips 20. In another embodiment, a plurality of anchor studs 23 are located at discrete intervals along the bottom side 16 opposite the lips 20. In this embodiment, there need not be holes or channels 25, because the distance between the discretely placed anchor studs 23 would provide sufficient area for liquid molding material to flow and minimize adverse pressure on the fastening member 10.

If anchor studs 23 are provided without an anchor layer 22, then the magnetically attractable layer 24 is fastened directly to the bottom side 16 of the base 12. The magnetically attractable layer 24 may be so fastened in any manner without departing from the spirit and scope of the invention, but is preferably fastened by an adhesive.

First and second end seals or end dams 26, 28 are provided at opposite ends of the fastening member 10, as illustrated in FIG. 3. The end seals 26, 28 also prevent fouling of the fastener elements by the molding material of the molded article, as described in greater detail below. These ends seals may be provided in any manner, but preferably are placed after the base 12 has been extruded. A first non-foam polymer material is disposed transversely across and in contact with the base 12 between the lips 20 at a first end 30 of the fastening member 10 to form the first end seal 26. A second non-foam polymer material is disposed transversely across and in contact with the base 12 between the lips 20 at a second end 32 of the fastening member 10 to form the second end seal 28. The second end seal 28 is disposed at a location different from the location of the first end seal 26. Preferably, the first and second end seals 26, 28 define the longitudinal edges of the fastening member 10. Material in the machine direction, however, may be present without departing from the spirit and scope of the invention.

The first and second end seals 26, 28 are made from a non-foam polymer, such as hot melt polyesters, polyimides, co-polyimides, ethylene vinyl acetates or urethanes. Preferably, the non-foam polymer is a polyimide. The first and second end seals 26, 28 preferably, but not necessarily, are made from the same material.

In one embodiment, first and second end seals 26, 28 are made from a foam and nonwoven construction applied to the ends of the fastening member 10. The foam is laminated or otherwise adhered or fastened to a nonwoven material and placed between the lips 20 and one or both ends of the fastening member 10. The seals 26, 28 are secured between the lips 20 by an adhesive, mechanical bond, or in any other manner without departing from the spirit and scope of the invention. The seals 26, 28 are provided, for example, at a height equal to or less than the height of the lips 20. In one embodiment, the seals 26, 28 are snapped into place between the lips 20 and secured by friction fit between the lips 20. The seals 26, 28 may be applied before or after cutting the base 12.

In other embodiments, a foam and woven material or a foam and film, such as a thermoplastic film, are used as the material of construction for first and second end seals 26, 28. The foam/woven or foam/film or other material are laminated or otherwise adhered or fastened together for use as the end seals 26, 28.

In one embodiment, the fastening member 10 is made by extruding the base 12 having the top side 14 and the bottom side 16. The extrusion includes integral longitudinal lips 20 on the top side 14 defining the lateral edges of the base 12 and the fastening member 10. Fastener elements 18 also are disposed on the top side 14. Preferably, the fastener elements 18 are integral with the base 12. Preferably, the fastener elements 18 are integrally extruded on the top side 14 of the base 12 and formed by a cut and stretch technique. But the fastener elements 18 may be formed or placed on the top side 14 of the base 12 by any method, such as lamination of pre-molded elements or printing of hook elements, without departing from the spirit and scope of the invention.

The base 12 preferably is a thermoplastic polymer, as above, and the lips 20 are the same or a different thermoplastic polymer, as above. The lips 20 may be co-extruded with the base 12. If the material of the lips 20 is different than the material of the base 12, then the materials should be compatible for co-extrusion, such as a nylon base 12 and polyvinyl chloride lips 20.

After the base 12 is extruded, the first non-foam polymer is applied transversely across and in contact with the base 12 between the longitudinal lips 20 to provide the first end seal 26 at the first end 30 of the base 12. The second non-foam polymer also is applied transversely across and in contact with the base 12 between the longitudinal lips 20 to provide the second end seal 28 at the second end 32 of the base 12. The second end seal 28 is placed at a location different from the location of the first end seal 26. Preferably, the first and second non-foam polymers are applied to the base 12 in fluid form. The first and second end seals 26, 28 are then allowed to substantially solidify.

In one embodiment, the base 12 is cut to a desired length before applying the first and second end seals 26, 28. In another embodiment, the first or second end seals 26, 28 are applied prior to cutting the base 12 to a desired length.

In one embodiment, the first end seal 26 is applied to the first end 30 of the base as it is extruded. Then the second end seal 28 is applied at a different location than the first end seal 26 and at a distance approximately corresponding to the desired length of the base 12. After the second end seal 28 is applied, the base 12 is cut through the second end seal 28. This cut is made through the second end seal 28 such that the second non-foam polymer provides an end seal both for a first piece of freshly-cut base 12 and for the remaining uncut base 12. Thus, the applied non-foam polymer that forms the second end seal 28 of the cut base 12 forms the first end seal 26 of the uncut base 12. Then additional non-foam polymer is applied as the second end seal 28 of the uncut base 12 and the uncut base 12 is cut through the newly applied second end seal 28 to form a second piece of freshly-cut base 12. This continues to create as many pieces of cut base 12 for fastening members 10 as desired.

In another embodiment, the first end seal 26 is applied to the first end 30 of the base as it is extruded. Then the second end seal 28 is applied a different location than the first end seal and at a distance approximately corresponding to the desired length of the base 12, but the base 12 is not cut. Additional non-foam polymer seals are applied at other locations along the base 12 as it is extruded. After a desired number of seals have been applied, the base 12 is cut through the non-foam polymer seals to form individual members 10 of desired lengths.

In another embodiment, the end seals 26, 28 are not applied to the base 12 as the base 12 is extruded, but at some point in time after the base 12 has been extruded. In this embodiment, the base may be manufactured and stored as a strip or other shape having no seals applied. When it is desired to make fastening members 10 of specific lengths, the end seals 26, 28 are then applied to the base 12 and the base 12 cut through the end seals into desired lengths, as described above. Alternatively, the base 12 is cut into desired lengths prior to applying the end seals 26, 28.

In one embodiment, the fastening elements 18 are formed after application of the end seals 26, 28. Other embodiments include formation, application, etc., of the fastening elements 18 before or after application of the end seals 26 or 28. The timing of the formation, application, etc. of the fastening elements 18 relative to the application of the end seals 26, 28 may be selected as desired.

In one embodiment, the anchor layer 22 is attached to the bottom side 16 of the base 12. Preferably, the attachment is made after placement of the magnetically attractable layer 24 and prior to cutting the base 12 to a desired length. The attachment of the anchor layer 22, however, may occur at any time, including after storage of the base 12, without departing from the spirit and scope of the invention. Preferably, the attachment is accomplished by ultrasonic welding of at least a portion of the anchor layer to the bottom side 16. Other methods of attachment are discussed above.

In one embodiment, the magnetically attractable layer 24 is placed between the anchor layer 22 and the bottom side 16 of the base 12 before the anchor layer 22 is attached to the bottom side 16. As best illustrated in FIG. 3, lateral portions of the anchor layer 22 are attached/adhered to the bottom side 16 with the magnetically attractable layer 24 disposed therebetween. The attachment of the anchor layer 22 to the bottom side 16 holds the magnetically attractable layer 24 in place.

Alternatively, the magnetically attractable layer 24 may be attached to, or part of, the bottom side 16 of the base 12. Then, the anchor layer 22 is attached to the bottom side 16 of the base 12 or the magnetically attractable layer 24 at a selected time thereafter.

Figure 13:
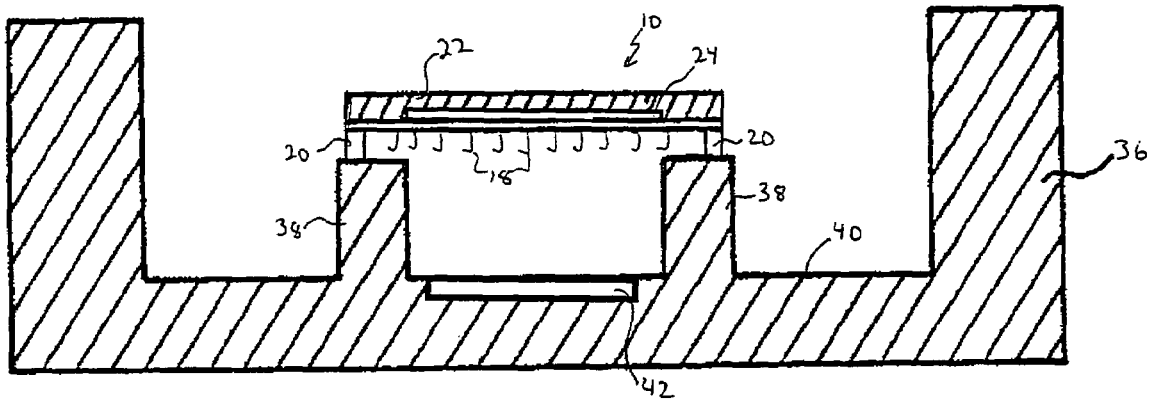
FIG. 13 is a representational view of one embodiment of an article of the present invention including a fastening member.

The fastening member 10 is capable of attachment to a molded article 34. In one embodiment, the attachment is accomplished by placing the fastening member 10 into a mold 36 in which the molded article 34 is to be formed, as illustrated in FIG. 13. The lips 20 (or extension surfaces 21, if provided) are placed in engagement with pedestals 38 extending upwardly into the interior of the mold 36. The end seals 26, 28 are also engaged with (not shown) the pedestal 38. The space between the fastening member 10 and the magnets 42 may be selected without departing from the spirit and scope of the invention. The area between the pedestals 38 in FIG. 13 may also be solid, such that there is a single pedestal 38. Alternatively, the fastening member 10 may be placed into the mold 36 such that the lips 20 and the end seals 26, 28 engage the bottom surface 40 of the interior of the mold 36 without the presence of a pedestal 38.

One or more magnets 42 in the mold 36 attract the magnetically attractable layer 24 of the fastening member 10 to hold the fastening member 10 in place as liquid molding material is placed into the mold 36. The placement of magnets 42 in the mold 36 or the pedestal 38 may be selected in any manner without departing from the spirit or scope of the invention.

The engagement of the lips 20 and the end seals 26, 28 with the pedestal 38 prevents the liquid molding material placed into the mold from entering the area with the fastener elements 18. This prevents fouling of the fastener elements 18. If the lips 20 are provided with extensions 19, as illustrated in FIG. 4, the extension surfaces 21 engage the pedestal 38. If the fastening member 10 is provided with one or more longitudinal walls 50, as illustrated in FIG. 6, then the lips 20 or the longitudinal walls 50 engage the pedestal 38, or both. The longitudinal walls 50 provide an additional barrier against fouling of the fastener elements 18.

As liquid molding material is placed into the mold 36, the molding material engages the anchor layer 22 (or anchor studs 23, if provided). The liquid molding material is allowed to solidify into the molded article 34 and the anchor layer 22 bonds with or otherwise attaches to the solidified molding material to attach the fastening member 10 to the molded article 34.

Figure 14:
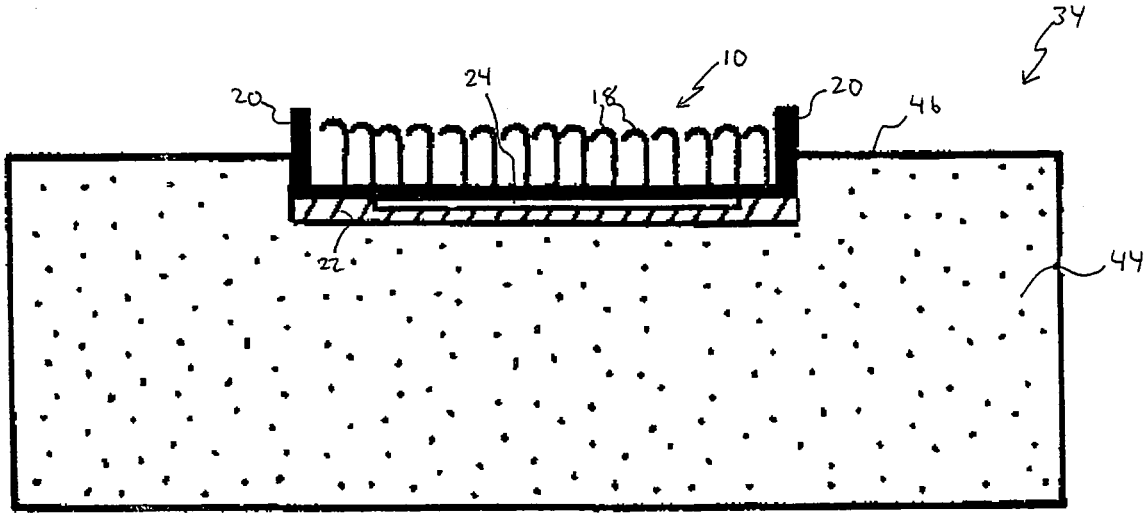
FIG. 14 illustrates the fastening member in accordance with the invention embedded in the surface of a molded article.

As illustrated in FIG. 14, the resulting molded article 34 includes the fastening member 10 attached thereto. FIG. 14 illustrates the fastening member 10 embedded in the surface 46 of the molded article 34. More than one fastening member

10 may be attached to the molded article 34. The anchor layer 22 is attached to the solidified molding material 44. The depth to which the fastening member 10 is embedded may be varied without departing from the spirit or scope of the invention.

EXAMPLE

In one example of making a fastener element without the magnetically attractable layer 24 and the anchor layer 22, the base is manufactured by extruding nylon 6 polymer through a profile extrusion die at about 440° F. The profile extrudate exits the die about 70% larger than will be the finished profile. The profile is brought to the desired size through the process relationship of the speed of the extruder and the run speed of the downstream puller/haul-off.

The profile includes the base, longitudinal lips defining the lateral edges of the base, and longitudinal lanes of hook-shaped material disposed between the lips.

Upon exiting the die, the hot profile extrudate is immediately fed into a cooling water tank to set the profile shape. The profile shape is stabilized and set when entering the water tank by sizing blocks or stabilizing fixtures. Profile distortion may occur as a result of turbulence in the tank water, so it is desirable to minimize water turbulence in the tank.

After the profile exits the water tank, it is blown dry by an air knife arrangement. After passing through the air knives, the profile is fed into a puller, which pulls the profile through the entire process after the extrudate exits the die. In other examples, the profile is not blown dry by an air knife.

Upon exiting the puller, the profile is bulk spooled on large diameter reels to minimize creating any bowed memory over the length of the profile. A flat profile section (width and length) is desirable for optimal processing in the seat foaming process.

To form the individual hook fastener elements, the stable profile is uncoiled from the bulk spool/reel and fed into a servo knife cutter, where the lanes of hook-shaped profile are cut into individual hooks and the longitudinal lips are left uncut. The profile then passes through a puller/haul-off, which pulls the profile through the servo knife cutter.

After exiting the puller, the base is exposed to elevated temperatures to soften the thermoplastic polymer. As the base softens, the profile, which is under a state of tension, elongates to create separation of the individual hooks. During the stretching process the overall width of the profile reduces to a specified dimension.

After passing through the heating stage of the process, the softened thermoplastic extrusion begins to cool and set with the ambient temperature. After reaching ambient temperature, the extrusion is a stable profile with separated individual hooks.

While the present invention has been illustrated by the above description of embodiments, and while the embodiments have been described in some detail, it is not the intent of the applicants to restrict or in any way limit the scope of the invention to such detail. Additional advantages and modifications will readily appear to those skilled in the art. Therefore, the invention in its broader aspects is not limited to the specific details, representative apparatus and methods, and illustrative examples shown and described. Accordingly, departures may be made from such details without departing from the spirit or scope of the applicants' general or inventive concept.

We claim:

1. A fastening member suitable for attachment to a molded article, the fastening member comprising:

a. a base comprising a first side and a second side;

b. at least one hook-shaped element for mating with at least one loop element, the at least one hook-shaped element extending away from the first side to a first height measured from the first side;

c. a first and a second longitudinal lip defining lateral edges of the fastening member formed integrally with the base and extending away from the first side to a second height measured front the first side, each lip having a width; and d. a first and a second uninterrupted longitudinal wall extending away from the first side and extending a longitudinal length of the base, each wall disposed laterally inward of and substantially parallel to a corresponding lip, and the at least one hook-shaped element is positioned between the first and second uninterrupted longitudinal walls; and e. at least one of an anchor layer attached to the second side of the base and one or more anchor studs extending from and integral with the second side of the base.

2. The fastening member of claim 1, wherein the longitudinal walls extend to the same height from the base as the longitudinal lips.

3. The fastening member of claim 1, wherein the second height is greater than or equal to the first height.

4. The fastening member of claim 1, at least one lip comprising a cavity therein.

5. The fastening member of claim 4, where in the cavity extends substantially the entire length of the lip.

6. The fastening member of claim 1, wherein the anchor layer is capable of securing the fastening member to molding material in the molded article.

7. The fastening member of claim 1, wherein the anchor layer comprises a fabric.

8. The fastening member claim 1, further comprising an adhesive between at least a portion or the anchor layer and the second side of the base.

9. The fastening member of claim 1, wherein the anchor layer is attached to the second side of the base by ultrasonic welding.

10. The fastening member of claim 1, further comprising a magnetically attractable layer between the anchor layer and the second side of the base.

11. The fastening member of claim 10, wherein the magnetically attractable layer comprises a metal strip.

12. The fastening member of claim 1, wherein the anchor studs comprise holes extending therethrough.

13. The fastening member of claim 1, further comprising a magnetically attractable layer within the base.

14. The fastening member of claim 1, wherein the at least one hook-shaped element is integrally formed with the base.

15. The fastening member of claim 1, wherein the base is extruded.

16. The fastening member of claim 15, wherein the lips are co-extruded with the base.

17. The fastening member of claim 1, wherein the lips comprise extensions having a surface substantially parallel to the base and having a width greater than the width of the lips.

18. The fastening member of claim 1, wherein the lips are disposed at about 90 degree angles relative to the first side of the base.

19. The fastening member of claim 1, wherein the lips are disposed at greater than 90 degree angles relative to the first side of the base.

20. The fastening member of claim 1, further comprising a first seal disposed at a first location on the fastening member transversely across and in contact with the base between the lips to provide a first seal at the first end.

21. The fastening member of claim 20, wherein the first seal comprises a non-foam polymer selected from the group consisting of polyesters, polyimides, ethylene vinyl acetates, urethanes, and co-polymers or derivatives thereof.

22. The fastening member of claim 20, wherein the first seal comprises a foam material in combination with a non-woven material, a film, or a woven material.

23. The fastening member of claim 20, further comprising a second seal disposed at a second location on the fastening member transversely across and in contact with the base between the lips to provide a second seal at the second end.

24. The fastening member of claim 23, wherein the second seal comprises a non-foam polymer selected from the group consisting of polyesters, polyimides, ethylene vinyl acetates, urethanes, and co-polymers or derivatives thereof.

25. The fastening member of claim 23, wherein the second seal comprises a foam material in combination with a non-woven material, a film, or a woven material.

26. A molded article having at least one surface wherein the fastening member of claim 1 is embedded in the at least one surface.

* * * * *